US007279072B2

(12) United States Patent
Muhonen et al.

(10) Patent No.: US 7,279,072 B2
(45) Date of Patent: Oct. 9, 2007

(54) METHOD AND APPARATUS FOR ADJUSTING OPERATION OF WIRE SECTION

(75) Inventors: Jukka Muhonen, Jyväskylä (FI); Hannu Korhonen, Jyväskylä (FI); Minna Partonen, Jyväskylä (FI); Jussi Rajala, Jyväskylä (FI); Antti Leinonen, Laukaa (FI)

(73) Assignee: Metso Automation Oy, Tampere (FI)

( * ) Notice: Subject to any disclaimer, the term of this patent is extended or adjusted under 35 U.S.C. 154(b) by 412 days.

(21) Appl. No.: 10/493,703

(22) PCT Filed: Nov. 11, 2002

(86) PCT No.: PCT/FI02/00883

§ 371 (c)(1),
(2), (4) Date: Aug. 20, 2004

(87) PCT Pub. No.: WO03/040465

PCT Pub. Date: May 15, 2003

(65) Prior Publication Data

US 2005/0006044 A1 Jan. 13, 2005

(30) Foreign Application Priority Data

Nov. 9, 2001 (FI) ..... 20012175

(51) Int. Cl.
*D21F 1/08* (2006.01)

(52) U.S. Cl. ..... 162/258; 162/199; 162/252; 162/253; 162/259; 162/262; 162/263; 162/DIG. 10; 162/DIG. 11

(58) Field of Classification Search ..... 162/198, 162/199, 252, 253, 258, 259, 262, 263, 274, 162/DIG. 6, DIG. 10, DIG. 11; 700/127–129
See application file for complete search history.

(56) References Cited

U.S. PATENT DOCUMENTS 3,620,914 A * 11/1971 Rocheleau ..... 162/198
5,300,193 A 4/1994 Rule, Jr. et al.

(Continued)

FOREIGN PATENT DOCUMENTS

EP 1 054 102 A3 11/2000

(Continued)

OTHER PUBLICATIONS

Raisanen et al. "Effect of Vacuum Level and Suction Time on Vacuum Assisted Drainage of a Paper Machine Wire Section," Appita 48th Annual General Conference, Melbourne 1994.

(Continued)

*Primary Examiner*—Eric Hug
(74) *Attorney, Agent, or Firm*—Oliff & Berridge, PLC.

(57) ABSTRACT

Adjusting the operation of a wire section, in which the development of the consistency of stock on the wire section (2) is determined and the effect of the consistency determined above on the formation and/or porosity of a paper web (3) is determined. The consistency developed on the wire section is adjusted based on a quality property of paper and/or by optimising a cost function, the quality property of paper comprising the formation and/or the porosity and/or a combination defined by means of the formation and/or the porosity and the cost function including the effect of at least the formation and/or the porosity.

23 Claims, 3 Drawing Sheets

U.S. PATENT DOCUMENTS

| | | | | |
|---|---|---|---|---|
| 5,812,404 | A * | 9/1998 | Hamalainen et al. | 700/128 |
| 5,825,653 | A | 10/1998 | Huovila et al. | |
| 5,879,513 | A | 3/1999 | Karvinen | |
| 6,162,331 | A * | 12/2000 | Ruf et al. | 162/198 |
| 6,203,665 | B1 | 3/2001 | Begemann | |
| 6,274,002 | B1 * | 8/2001 | Rulis et al. | 162/352 |
| 6,805,772 | B2 * | 10/2004 | Schwarz | 162/198 |

FOREIGN PATENT DOCUMENTS

| | | |
|---|---|---|
| EP | 1 063 348 A3 | 12/2000 |
| FI | 97 244 | 11/1996 |
| FI | 19 992 430 | 11/1999 |

OTHER PUBLICATIONS

Raisanen, "Water Removal by Flat Boxes ABD a Couch Roll on a Paper Machine Wire Section,"Helsinki University of Technology, Laboratory of Paper Technology Reports, Series A10, Espoo 1998.

* cited by examiner

METHOD AND APPARATUS FOR ADJUSTING OPERATION OF WIRE SECTION

FIELD OF THE INVENTION

The invention relates to a method for adjusting the operation of a wire section.

The invention also relates to an apparatus for adjusting the operation of the wire section.

BACKGROUND OF THE INVENTION

A paper machine includes a headbox, from which stock is fed onto the wire section, or former, where the stock forms a fiber web or sheet. From the wire section, the fiber web is conveyed to a press section and from there to a drying section, and thereafter the paper is reeled using a reel.

SUMMARY OF THE INVENTION

The object of controlling the operation of a wire section is to provide on the wire section a web that is as homogeneous as possible. The homogeneity may be evaluated as a formation that describes the basis weight small-scale distribution at the web level. The structure of the web in z direction must also be appropriate regarding the printing properties. The formation affects the physical and optical properties of the paper. As the formation becomes worse, the occurrence probability of the thin spots increases, whereby the number of pinholes increases and the unevenness of the strength properties increases. Manufacturing coated types of paper in particular, the increased air permeability of the paper web, or the porosity, and the possible pinholes deteriorate the runnability of a coater. When calendering a web provided with a poor formation, the density distribution in the paper level direction becomes uneven, and causes the printing ink to be unevenly absorbed and thus a patchy print quality. The fines distribution in z direction of the paper web is also significant when the printing properties of the finished paper are evaluated. Particularly the difference in the amount of fines on the upper and lower side of the paper web should generally be as small as possible. In addition, the dry solids content of the paper web succeeding the wire section is a significant factor for the operation of the entire paper machine. If the dry solids content is too low, the edge cutting deteriorates, which increases edge faults. Likewise, too low dry solids content weakens the reliability of the operation, when the paper web is conveyed from the wire section to the press section. Furthermore, when the dry solids content is loo low, there is a chance for sheet crushing, for instance, when the paper is pressed, the difference in draw between the press and dryer section must be increased, and above all the runnability of the paper machine declines.

Typically, the wire section is regulated by adjusting the vacuums of dewatering elements in the wire section and the slice opening of a headbox. Adjusting the slice opening may affect the consistency of headbox stock and thus increase or reduce the amount of water to be conveyed onto the wire section. It is also possible to adjust the tensions of the wires in the wire section and thus to affect the drainage of the dewatering elements.

An operator of a machine typically controls the operation of a wire section, and builds his/her evaluation on the operation of the process on a visual estimation on the formation of manufactured paper, and sometimes on the probable formation measurements to be carried out. In some cases, the drainage state is observed using drainage measurements that allow the operator to empirically estimate the quality of the web to be formed and if necessary to adjust the vacuums of the dewatering elements or the slice opening of the headbox. A cross web sample, from which the paper web properties such as the formation are evaluated, is always taken when a roll is changed, i.e. typically about once per hour.

What significantly affect the drainage taking place on the wire section are the infiltration properties of the stock, which strongly depend on the freeness, the chemical state, the fibres clinging to one another i.e. flocculation, the fines content and temperature of the stock. The infiltration properties of the stock cannot currently be measured in conditions that fully correspond with those of a paper machine, and therefore the behavior of the stock in the drainage process on the wire section cannot be fully predicted in advance. In addition, due to the varying stock properties required by different paper grades, the behavior of the drainage process may change several times during the day in the paper machine. Moreover, difficulties may occur in the stock preparation process owing to the changes taking place in the mutual dosage ratios of the stock components that may be caused by the changes in the dosage of the broke. It may therefore be very difficult for the operator to optimally manage the control of the wire section. Since the formation of the bottom of the paper cannot be assessed other than using rarely taken samples, the operator must leave an extensive safety margin for the control in order to avoid sheet crushing, when the sheet is affected by the dewatering elements loading the web, or the web from becoming flocked owing to the possible changes occurring in the infiltration properties of the stock taking place between sampling.

FI publication 97 244 shows a method for adjusting the drainage of the wire section, in which method each dewatering unit is provided with a drainage strategy. The amount of water drained by each dewatering unit is measured and the measured amount of water is compared with a set value. If the removed amount of water and the set value are of different size, the rotation speed of the electric motor of the vacuum pump in the dewatering unit is adjusted, for instance. U.S. Pat. No. 5,879,513 discloses a method for adjusting drainage so as to measure the amount of water to be drained in the dewatering element and to adjust the vacuum capacity on the basis thereof. However, in both above publications the operator has to determine the set values in the conventional way shown above. Consequently, all the problems are present in the solution for optimising and adjusting the wire section according to the cited publications.

Article "Effect of Vacuum Level and Suction Time on Vacuum Assisted Drainage of a Paper Machine Wire Section", Kari Räisänen, Hannu Paulapuro and Ari Maijala, APITA 48$^{th}$ Annual General Conference, Melbourne 1994 studies how the vacuum in the dewatering elements of a wire section affect the formation of a web. The article also presents a method, which tends to predict the drainage in a wire section utilizing a mathematical formula. The idea is to be able to minimize the energy consumption of a wire section or to achieve a dry solids content in the web that is as extensive as possible using particular energy consumption. The solution does not adequately consider the rapid changes occurring in the stock or in the process, and said solution is therefore not able to optimise the operation of the wire section as accurately as desired.

FI publication 19992430 shows a method for determining the dry solids content of a paper machine and the development and/or control thereof. In this method, the dry solids content is determined at a desired point based on a measured liquid amount and a dry basis weight of the web. Measuring the amount of drainage in the dewatering elements of the wire section and taking the determined dry solids content into account, the dry solids content of the paper web can be determined on the desired locations. The obtained dry stuff information allows adjusting, for instance, the pressing pressures and/or the vacuum levels in the wire section in order to achieve the desired dry stuff development. However, the solution does not allow optimising the operation of the wire section as accurately as desired.

EP publication 1 063 348 discloses a method for controlling the amount of water on the paper web and for preventing flocks to be formed on the paper web to be produced. In this method, the amount of water on the paper web is determined in the direction of movement of the web on different locations of the wire section, wherefore the amount of water to be removed from the web is adjusted by controlling the function of suction boxes. In addition, after the press section or the dryer section, the light transparency characteristic of the web is measured, on which basis the operation of blades arranged on the wire section is controlled, the blades being intended to cause turbulence breaking fiber flocks. The control is thus based on controlling the angle of the mechanical components in the wire section. However, such a solution is not capable of optimising the operation of the wire section as desired.

U.S. Pat. No. 5,825,653 shows an adjustment method for a wire section based on a fluid flow model, where flow calculation allows adjusting the wire section. A physical fluid flow model is formed in the solution that is based on the drainage of the wire and the flow state of the stock suspension. The drainage of the wire is measured from several locations on the wire section by measuring the amount of water drained from different locations, and the flow state of the stock suspension is determined by means of the stock jet velocity, the wire speed and the consistency of the stock. The quality of the paper is monitored at the dry end of the paper machine. The model determines the aimed flow state as well as the difference between the aimed flow state and the current flow state, from which a cost function is formed that allows determining new control and set values to reach the aimed flow state. The solution thus requires forming a physical fluid flow model, whereby the method becomes very complicated and requires considerably more expertise.

It is an object of the invention to provide a method and an apparatus to allow controlling the operation of a wire section optimally.

The method of the invention is characterized by determining the development of the consistency of stock on a wire section, determining the effect of the consistency determined above on the formation and/or porosity of a paper web and adjusting the consistency developing on the wire section based on a quality property of paper and/or by optimising a cost function, the quality property of paper comprising the formation and/or the porosity and/or a combination defined by means of the formation and/or the porosity, and the cost function including at least the effect of the formation and/or the porosity.

The apparatus of the invention is characterized by comprising means for determining the development of the consistency of stock on a wire section, means for determining the effect of the consistency determined above on the formation and/or porosity of a paper web and means for adjusting the consistency developing on the wire section based on a quality property of paper and/or by optimising a cost function, the quality property of paper comprising the formation and/or the porosity and/or a combination defined by means of the formation and/or the porosity, and the cost function including at least the effect of the formation and/or the porosity.

The development of the consistency of the stock on a wire section is determined and the effect of the consistency on the formation and/or porosity of the web is determined. Furthermore, the consistency arriving at a particular dewatering element is adjusted based on said quality property of paper, i.e. the formation and/or porosity, and/or by optimising a cost function, which contains the effect of the formation and/or the porosity. The idea of a first embodiment is to determine an optimal value for the consistency in such a manner that the ratio between a first derivative of said quality property of paper and/or the cost function and a first derivative of the consistency is determined. The idea of a second embodiment is to determine a correct control direction of the consistency using the ratio between the first derivative of the quality property of paper and/or the cost function and the first derivative of the consistency, as well as the magnitude of a control step using the ratio between a second derivative of said quality property of paper and/or the cost function and the first derivative of the consistency. The idea of a third embodiment is to determine the development of consistency on the wire section by determining the dry solids content on the web succeeding the wire section and measuring the water amounts drained by the dewatering elements in the wire section and calculating the development of the consistency on the wire section on the basis of the drained water amounts. The idea of a fourth embodiment is to adjust the consistency by adjusting a slice opening of a headbox and/or the drainage of the dewatering elements on the wire section. The idea of a fifth embodiment is to employ a fuzzy controller to implement the adjustment of the consistency, in which the adjustable consistency and the adjusting variables are provided with boundary conditions. The idea of a sixth embodiment is to adjust the consistency by optimising in accordance with such a cost function that includes both the quality deviation cost and the control cost. Thus, the quality deviation cost takes into account the runnability of the process and/or the dry stuff requirement set by the quality property of paper between different elements and/or the wire section and the press section. Then again, the control cost considers the required power and/or driving output of the wire section in order to achieve drainage.

The invention provides such an advantage that the operation of the wire section can be adjusted as optimally as possible to provide a web that is excellent regarding the formation, porosity and dry solids content. In the embodiment utilizing the cost function, the provided cost function allows determining the weighting of different quality parameters concerning the adjustment measures aiming at a most preferable operation point. It is possible to select whether the main emphasis lies on formation or porosity. The invention enables to optimally adjust the consistency arriving at each dewatering element in such a manner that the safety margin concerning the adjustment may be very small. Furthermore, the invention allows controlling the development of the consistency of the web particularly well.

In this application, the term 'paper' refers in addition to paper also to board and tissue.

BRIEF DESCRIPTION OF THE DRAWINGS

The invention will be explained in more detail in the accompanying drawings, in which.

DETAILED DESCRIPTION OF EXEMPLARY EMBODIMENTS

Figure 1:
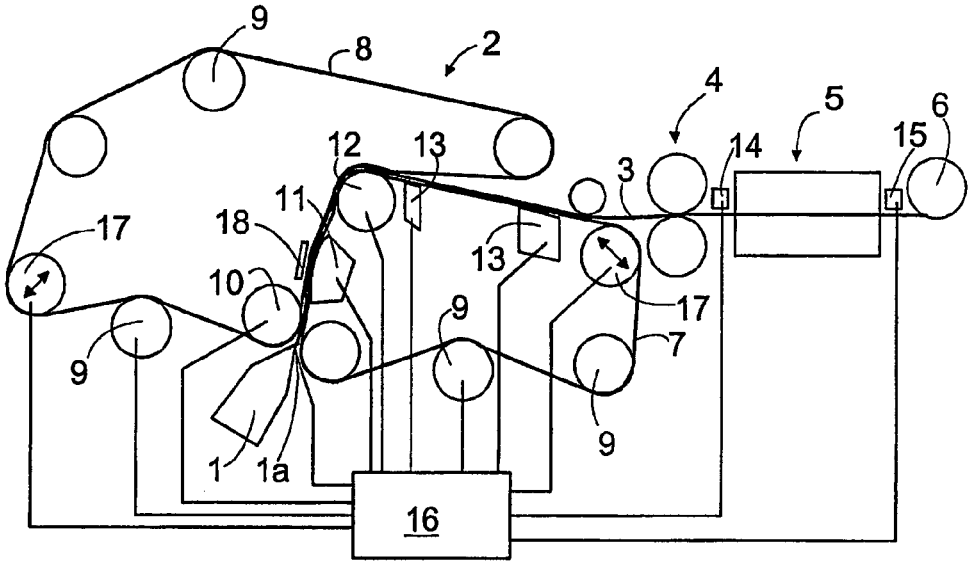
FIG. 1 is a side view schematically showing a paper machine.

FIG. 1 schematically shows a paper machine. The paper machine comprises a headbox 1, from which stock is supplied to a wire section 2, i.e. a former, where a paper web 3 is formed of the stock. The paper web 3 is conveyed to a press unit 4 and from there to a dryer unit 5. From the dryer unit 5 the web is conveyed to a reel 6. A paper machine may also comprise other parts, such as a size press or a calender, which are not shown in FIG. 1 for the sake of clarity. Furthermore, the operation of a paper machine is known to those skilled in the art and is therefore not explained in detail in this context.

In FIG. 1, a so-called gap former forms the wire section 2. The gap former comprises an inner wire 7 and an outer wire 8, and a jet of the headbox 1 is driven into the gap between said wires. The wires 7 and 8 are guided by guide rolls 9. Some of the rolls are made movable in such a manner that the tensions of the wires 7 and 8 can be adjusted by moving said strecher rolls 17. In FIG. 1, a double-ended arrow indicates the movable strecher rolls 17.

Water is at first removed from the stock on the wire section 2 using a forming roll 10. The drainage of the forming roll 10 is typically 65 to 80% of the flow of the headbox 1. What affects the drainage pressure of the forming roll 10 is the pressure caused by the tension of the inner wire 7, the pressure reduction towards the outer wire 8 caused by centrifugal acceleration and the pressure prevailing inside the forming roll 10. Water is removed from the stock in the area close to the forming roll 10 both towards the forming roll 10 and on the side of the inner wire 7. Because of a continuous and symmetrical drainage, the tight surface layers of paper holding the fillers and fines on the paper are infiltrated. Water is removed without pulsating heavily in both directions simultaneously making the surfaces of the web more compact by bringing fines thereto.

After the forming roll 10, there is provided a multifoil shoe 11, which is composed of several blades. The radius of curvature in the multifoil shoe causes a drainage pressure. A trailing angle is formed over an individual blade within the area of the multifoil shoe 11 that is caused by the geometry of the blade. Because of the blades, the drainage of the multifoil shoe 11 becomes pulsating. The pressure pulses caused by the multifoil shoe and by other possible loadable blades 18 create shear forces into the free suspension within the web that further create velocity gradients breaking the fiber flocks in the suspension. Breaking the fiber flocks improves the formation of the web. The loadable blades 18 are not required in all former types. If the former is provided with loadable blades 18, said blades enable to increase the strength of the pulsation within the area of the multifoil shoe 11. The multifoil shoe 11 typically comprises several low-pressure chambers, whereby the use of vacuum strengthens the pressure pulses and increases the drainage pressure caused by the radius of curvature of the element. Increasing the vacuums of the multifoil shoe 11 generally also makes the web compact. Adjusting the drainage of the forming roll 10 and the multifoil shoe 11 enables to affect the quality property of paper, such as formation, porosity and the form of the filler distribution. The drainage of the forming roll 10 indirectly affects the formation, porosity and bonding strength of the paper. If the drainage of the forming roll 10 is increased too much, the input consistency of the multifoil shoe is reduced too much and the formation of the paper deteriorates. At the same time, the web 3 becomes more compact and the bonding strength improves.

The consistency of the stock conveyed onto the wire section 2 may range between 0.2 and 1.2%. The dry solids content of the paper web 3 leaving the wire section 2, in turn, typically ranges between 15 and 20%. The forming roll 10 is used to remove about 65 to 80% water from the flow of the headbox 1, in which case the consistency of the stock ranges from 2 to 3%. After the multifoil shoe 11, the consistency is approximately 4 to 5%. After the multifoil shoe 11, the wire section 2 also comprises a couch roll 12 and one or more suction boxes 13 as dewatering elements. In addition, one or more suction boxes can be provided before the couch roll 12. The couch roll 12 and the suction boxes 13 may affect the quality property of paper only slightly. However, the dewatering elements enable to increase the dry solids content of the paper web.

The paper machine also comprises measuring instruments for measuring the properties of the paper web 3. A first measuring instrument 14 may be arranged for instance in connection with the press section 4 and a second measuring instrument 15 may be arranged after the drying section 5. The paper machine also comprises a control unit 16, to which data concerning the properties of the paper web 3 are supplied from the measuring instruments 14 and 15. In addition, measuring data from the processing elements of the paper machine is supplied to the control unit 16. The control unit 16 controls, for instance, the dewatering elements of the wire section 2, such as the forming roll 10, the multifoil shoe 11, the couch roll 12 and the suction boxes 13, particularly the vacuums thereof. The control unit 16 also controls the tension of the wires 7 and 8 by controlling the movable strecher rolls 17. Furthermore, the control unit 16 adjusts a slice opening 1*a* of the headbox 1.

Figure 2:
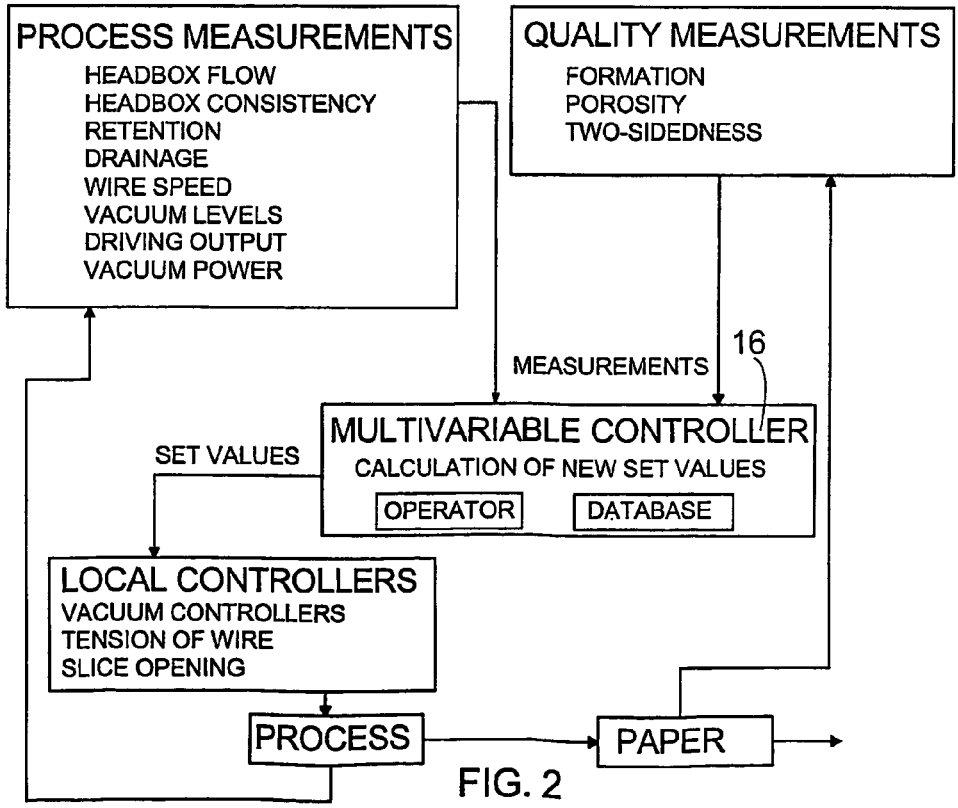
FIGS. 2 and 3 are block diagrams showing the control system of a wire section.

FIG. 2 is a block diagram showing the control system of a wire section. The control unit 16 is a multivariable controller, which provides local controllers with set values. The multivariable controller includes a dynamic model describing the operation of the wire section that is updated in accordance with the measurements. Local controllers adjust, for example, the vacuums of the dewatering elements in the wire section 2 or the tensions of the wires 7 and 8 or the slice opening 1*a* of the headbox. The aim of the multi-variable controller is to stabilize the quality property of paper by changing the running parameters of the wire section 2 in such a manner that the effect of possible interference taking place during the infiltration of the stock on the operation of the wire section 2 can be prevented, and to adjust the consistency of the stock for the elements in the wire section affecting the quality of the paper so that the formation and/or porosity of paper can be as good as possible.

The local controllers thus affect the process that provides paper. The local controllers are not explained in more detail in this context, since the structure and function of said controllers are apparent for those skilled in the art.

The feedback required in adjustment is obtained firstly by measuring the quality property of paper. The measuring instruments 14 and 15 may be used to measure, for instance, the basis weight, moisture, on line formation and porosity of the paper. Two-sidedness can be estimated using laboratory measurements. What are measured from the process are for instance vacuums, flows and consistencies. Measurable properties include the flow of the headbox, the consistency of the headbox, retention, drainage, wire speed, low-pressure levels, driving output and the power used for providing vacuum. The multivariable controller is a high level controller that calculates new set values for local controllers of a lower level based on the measurements.

Figure 3:
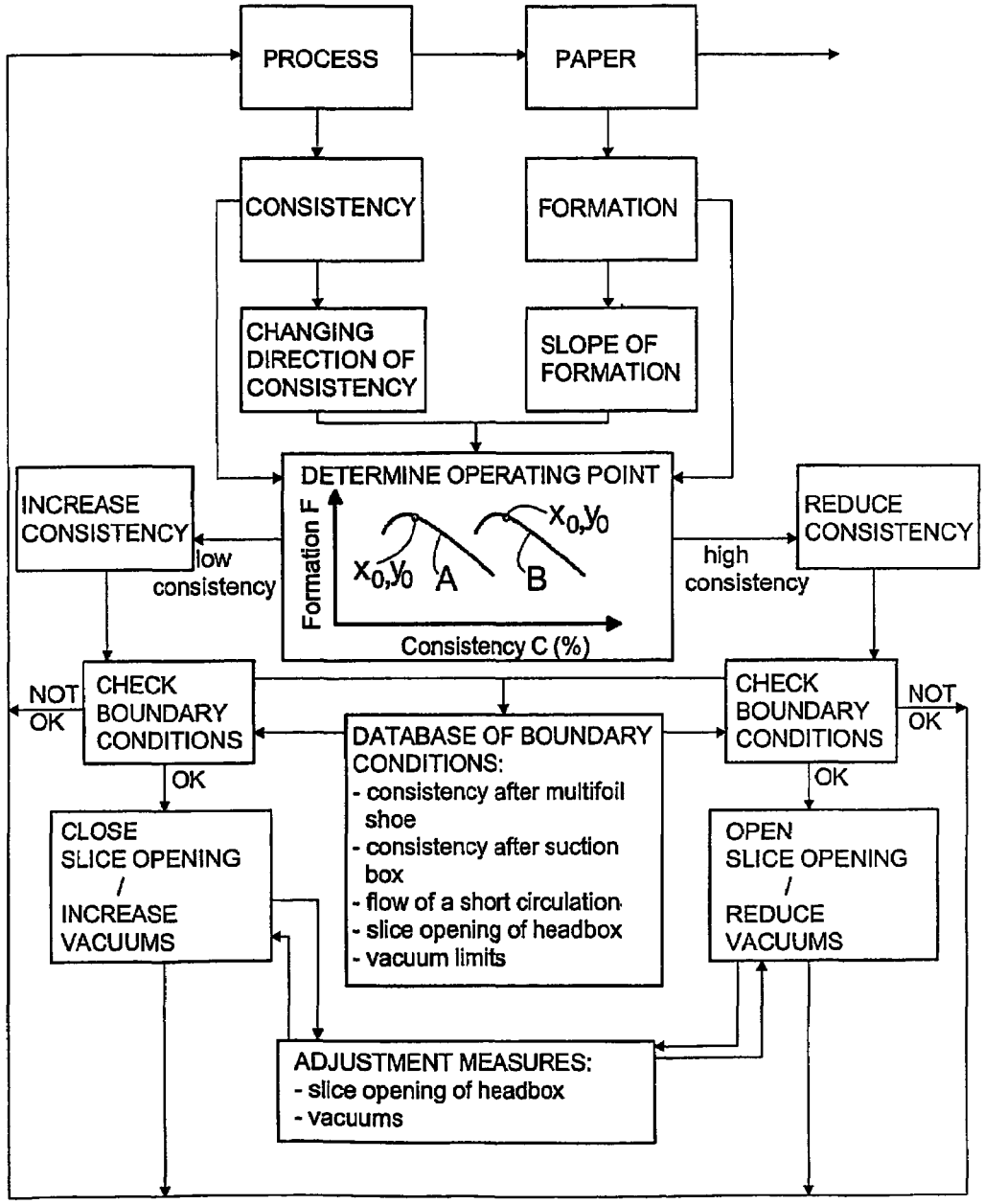

FIG. 3 shows a preferable way to optimise the operation of the wire section. According to the solution, feedback is taken into account in control both for the paper quality using formation and for the process by considering how the consistency has developed on the wire section 2. The formation can be determined, for instance, using the second measuring instrument 15 by measuring the optical on line formation after the dryer section 5. When measuring the formation using a measuring instrument that moves back and forth in the transverse direction of the paper web 3, the formation can be considered particularly on such a location of the paper web 3, which is discovered to react susceptibly on the changes regarding drainage. For example, a starting sheet crushing may appear as a stripe at a particular place on the paper web 3. How the consistency develops on the wire section can also be determined by measuring it locally. Implementing the consistency measuring is, however, a demanding task, and therefore a calculatorily determined consistency can be utilized. In principle, the development of the consistency can be determined, when the consistency of the headbox is known as well as the water amount drained by each dewatering element in the wire section. The consistency calculated in this way is, however, inaccurate. What causes inaccuracy in this method is, for instance, the fact that most of the drainage of the wire section 2 takes place in the area of the forming roll 10. Thus, the consistency is most preferably determined using backward calculation. The basis is then the dry solids content of the paper web 3 after the press section 4 and the basis weight after the dryer section 5. Such data can be obtained, for example, using measuring instruments 14 and 15. The amount of water drained on the press section 4 can be measured, whereby the dry solids content can be determined after the wire section 2. How the consistency is developed on the wire section 2 can be determined by means of backward calculation, when the amount of water drained by the dewatering elements in the wire section 2 is known, i.e. a model is developed on how the consistency develops on the wire section 2.

Since the dependencies between different properties are not linear and the process includes several interference factors, which are taken into account preferably by implementing the adjustment using a fuzzy controller. For example, owing to the variety of stock properties, it is difficult to definitely predict the magnitude of the consistency arriving at the dewatering element in order to provide the best possible formation. Therefore, the control must be provided with feedback to the paper quality. When fuzzy control is concerned, the restricting factors such as maximum slice flow, required dry solids content succeeding the wire section or required formation/porosity can be considered as the boundary conditions. Owing to the boundary conditions, the dewatering element cannot be provided for instance with a vacuum that is too high as a set value. The two-sidedness of the fines and filler distribution obtained during laboratory measuring can be taken into account when an optimal distribution is calculated for drainage between the upper and lower sides of the web on the wire section 2. This can be considered when the low-pressure settings of the first dewatering elements or the wire tensions of the wire section are concerned, whereby the drainage can be controlled more accurately in the upper or lower direction of the web. If the tensions of the wires are not adjusted, then the excess drainage at the upper or lower sides can be prevented by providing the controller with boundary conditions, within the scope of which the low-pressure settings and thus the dewatering distribution can be changed. Furthermore, the database of the boundary conditions may include data on, for instance, the allowed consistency after the multifoil shoe or on the consistency after the suction box. The database of the boundary conditions may further include the data about the flow concerning a short circulation.

The element-specific drainage measurements to be carried out allow calculating the dewatering distribution between different elements. An optimal dewatering distribution can be found by optimising the drainage of the elements heavily affecting the formation of the bottom, i.e. the forming roll 10 and the multifoil shoe 11, to such a point, in which the formation and/or porosity measurement provides a set value.

The operation of the wire section 2 is optimally adjusted for instance in accordance with the principle shown in FIG. 3. The effect of the consistency on the formation of the web must be determined for optimisation. It has been noted in performed tests that when the consistency arriving at a particular dewatering element decreases, the formation improves, but only to a certain extent. When the consistency decreases too much, the formation becomes drastically worse, as the already infiltrated fiber matting is damaged, when being loaded with pressure pulses, while the consistency is still too low. This so-called sheet crushing evidently causes detectable stripes to the paper web 3. A curve shaped as curve A in FIG. 3 depicts the value of the formation while the consistency changes. The shape of curve B corresponds to the shape of curve A and both curves A and B describe in FIG. 3 the operating areas of the wire section.

At first, the operating area has to be determined, i.e. whether the operating area is curve A or curve B or another substantially, equally shaped curve placed somewhere else on the horizontal axis. Basic data on the structure of the paper machine and on the stock is required for determining the operating area. The operating area is determined by identifying the papermaking process within the area of the wire section. A dynamic model is developed from the process that is continuously specified using the measurements of the process. The shape of curves A and B is therefore determined experimentally.

When the operating area, for instance A or B, is determined, the operation of the wire section is to be adjusted so that an operating point, i.e. $x_0$, $y_0$, providing the best possible formation is formed as the operating point. The operating point $x_0$, $y_0$ should therefore be as close as possible to the zenith of curve A or B. If the operating point $x_0$, $y_0$ is exactly at the zenith, there is a risk that the formation abruptly starts to decrease, when the starting values of the process change, if the consistency is reduced too much. The operating point $x_0$, $y_0$ should therefore be selected slightly to the right of the zenith. However, in the solution of the invention, the operating point $x_0$, $y_0$ need not be moved far away from the zenith, since the operation of the wire section can be perfectly controlled. It should also be considered, when determining the operating point $x_0$, $y_0$, that the paper web 3 must not be too wet after the wire section 2. In other words it should be noted when determining the operating point that the dewatering capacity of the end part of the wire section is sufficient in order to provide a dry solids content that is adequately high.

The shape of curves A and B are thus known, meaning that they are known in the following form $y-y_0=f(x-x_0)$, where y is formation, $y_0$ is formation at a reference point, x is consistency and $x_0$ is consistency at the reference point.

An optimal value must therefore be determined for the operating point $x_0$, $y_0$. If the shape of curve A or B is flat, meaning that the formation does not decrease too rapidly below a certain consistency, the operating point $x_0$, $y_0$ can be determined utilizing a first derivative. When determining the operating point, the property, i.e. consistency, on the x-axis is systematically disturbed, and variable dy/dx is at the same time continuously determined, i.e. the ratio between the first derivative of the formation and the first derivative of the consistency, i.e. d(formation)/d(consistency). Disturbing the consistency means that the consistency is changed for example by changing the vacuum of a dewatering unit. The disturbance takes place systematically in such a manner that minor changes are continuously caused to the consistency. The variance in the consistency must naturally be adequately large, meaning that the consistency change should cause a change in the response, i.e. in the form ation. The variable d(formation)/d(consistency) thus refers to the formation change after the change in the consistency has taken place. The variable dy/dx can be determined constantly or at appropriate intervals.

In an optimisation situation the consistency is controlled in such a direction that the derivative or dy/dx becomes the desired, i.e. the value thereof is close enough to zero. In this way the operating point is search for on curve A or B, where the slope of the curve is appropriate when the operating point is located on the right from the top of the curve. A threshold value can fairly easily be determined by experimenting when the size of the derivative is adequately close to zero When an operating point is optimised, formation, porosity and dry solids content can be selected as adjustable properties, and headbox slice flow, vacuum of a forming roll and vacuum of a multifoil shoe can be selected as adjusting properties or variables. In such a case, three adjustable properties and three adjusting variables are provided, whereby for instance simplex optimisation can be used in optimisation.

If the shape of curves A or B is inconvenient, i.e. when the consistency changes the formation drastically drops, an optimal operating point $x_0$, $y_0$ can also be found in such a case, but then a second derivative of the formation is also utilized. In such a case, the ratio between the first derivative of the formation and the first derivative of the consistency is determined and thereafter the ratio between the second derivative of the formation and the first derivative of the consistency is determined. The shape of the curve in the operating point $x_0$, $y_0$ is determined based on the second derivative. A control step size of the consistency is determined based on the shape of the curve. If the second derivative is very high, it indicates that the direction of the curve changes very rapidly, whereby the control step size must be very small. An appropriate threshold value of the size of the second derivative and the length of the control step to be determined based on the second derivative can be determined fairly easily by experimenting. The control step must be so small that the operating point is not driven to an undesired operating area, meaning that the formation should not deteriorate extensively. The dead time of the process is obviously taken into account between the control steps, said dead time determining how often control steps can be provided, i.e. how often the consistency can be changed. In addition, if the second derivative indicates that the direction of the curve changes very rapidly, the operating point should not be optimised close to the top, so as not to be placed on the left side of the top in an undesired operating area starting shortly. If, in turn, the second derivative indicates that the curve is very flat, it is possible to place the operating point close to the top. In brief, the variable d(formation)/d(consistency) allows determining the correct control direction of the consistency and the size of the control step can again be determined using the variable d(d(formation)/d(consistency).

If the consistency has to be changed, the boundary conditions will be checked. If the boundary conditions prevent the consistency to be altered, then no changes can be made, instead the process returns to determine the consistency and the formation. If the boundary conditions allow making changes, such as controlling the slice opening 1*a* of the headbox 1 or adding or reducing the vacuums of the dewatering elements, then the control method shown allows optimising the drainage state, whereby it is possible on the wire section to divide the drainage between different elements in such a manner that the best possible result is obtained regarding the formation, porosity, distribution of the upper and lower sides of drainage and the final dry solids content.

It should be noted when the operation of the wire section is adjusted that in the process the wire section is provided with two velocity constants as far as consistency is concerned. Firstly, the consistency may change rapidly when the properties of the stock change. Disturbance, such as disturbance in the basis weight, in the stock may therefore cause a rapid change to the consistency. Then again, when the optimum value of consistency is searched for, the consistency changes fairly slowly. Consequently, the shape of curves A and B shown in FIG. 3 changes very slowly.

The porosity and formation react differently to different changes. If the stock becomes more compact, the porosity decreases. However, it has been observed when adjusting the wire section that if the properties of the stock remain unchanged and the wire section is simultaneously adjusted in such a manner that the formation increases, the porosity increases at the same time. Consequently, the porosity may set a boundary condition on how to adjust the wire section in order to improve the formation. Instead of aiming to improve the formation, the wire section can also be adjusted in such a manner that the aim is to provide such a porosity that is as appropriate as possible for the final product. The adjustment based on porosity can principally be carried out in a corresponding manner as is shown in FIG. 3. Thus, the formation naturally may set a boundary condition on how to adjust the porosity.

Instead of determining the ratio between the derivative of the formation and the derivative of the consistency in FIG. 3, a ratio between the derivative of the porosity and the derivative of the consistency can be determined. In addition, the quality property of paper can be determined comprising the formation and/or the porosity and/or a combination defined by means of a formation and/or porosity. Also, in addition to or instead of the above possibilities, a cost function can be determined that includes at least the effect of the formation and/or the porosity and may further comprise, for instance, the effect of a wire section and/or the dewatering elements thereof on the consistency, and the consistency developed on the wire section is adjusted by optimising the cost function. Thus, when determining the operating point and searching for the correct control direction of the consistency, a ratio between the first derivative of the quality property of paper and/or the cost function and the first derivative of the consistency is determined, and when determining the size of the control step, a ratio between a second derivative of the quality property of paper and/or the cost function and the first derivative of the consistency can be determined.

When changing the grade, grade-specific set values stored in the database of the control system can be used as rough set values; the grade-specific set values are introduced in accordance with predetermined ramping. The grade change does not lead to an unstable operating area and the optimal running values can be rapidly achieved after the grade change.

Figure 4:
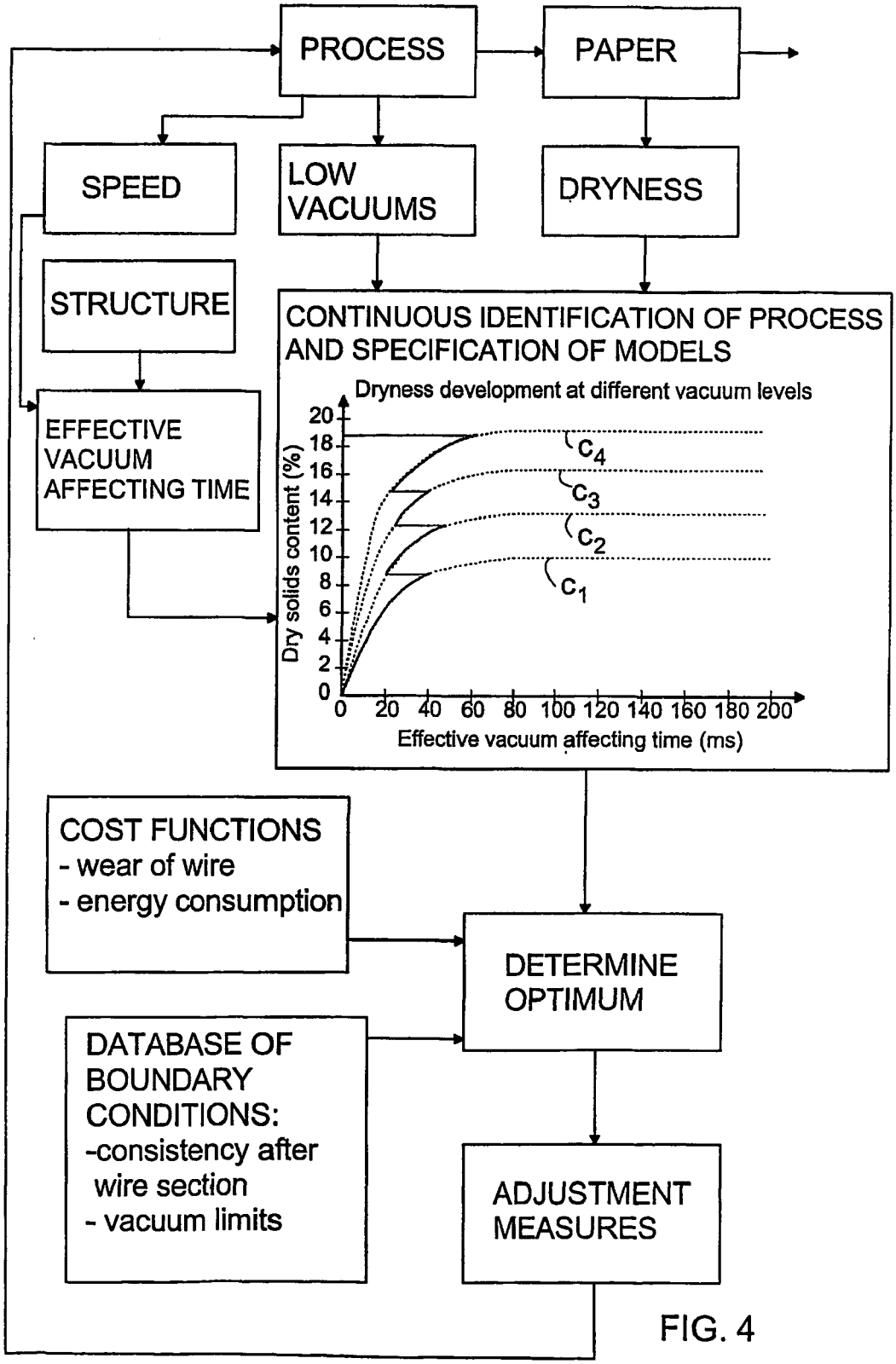
FIG. 4 is a block diagram showing how to optimise the operation of a wire section.

FIG. 4 shows a solution, how the vacuum in the dewatering elements at the end part of the wire section can be optimally distributed between different elements. At this stage, the consistency is so extensive that the of the paper web, such as formation or filler distribution, cannot be affected any longer. This occurs when the consistency is so high that the fibres can no longer move in relation to one another. In general, this occurs within the consistency range from 6 to 10%. What is determined from the paper is the dryness development and from the process the vacuums of the elements and the paper machine speed. What is also known is the structure geometry of the wire section, whereby the effective suction time in each dewatering element can be determined. Curves C1 to C4 indicated with a dashed line depict the drainage ability in each dewatering element. An unbroken curve describes how the dry solids content is developed in the paper web as a function of the affecting time of vacuum. Curves C1 to C4 can be determined for instance in accordance with publication Räisänen K., "Water Removal by Flat Boxes and a Couch Roll on a Paper Machine Wire Section", dissertation, University of Technology, Paper Technology Laboratory, Espoo, 1998, page 62. Curves C1 to C4 may depict the drainage of successive couch rolls and/or suction boxes. Furthermore, the cost functions are taken into account regarding the wear of the wires and the energy consumption of the low-pressure pumps. The database of the boundary conditions includes defined values for the consistency succeeding the wire section and boundary conditions for vacuums. Based on these values the optimal value is determined, whereby the computational model allows distributing the vacuum between different elements in such a manner that the need for suction energy is as small as possible and the wear of the wires remains minimal. What is obtained by means of on line process measurements and consistency calculation is continuous feedback from the dryness, and thus models describing the development of the dryness functioning as the basis of the optimisation calculation can be continuously updated.

Because the wire wears, the vacuums must be changed in order to obtain a desired consistency level on a particular location of the former. In addition, the development of the consistency must be changed, if the vacuums are too high, in which case the wire wears rapidly. The consistency is preferably adjusted by optimising on the basis of such a cost function that includes a quality deviation cost and a control cost. The quality deviation cost then takes into account the runnability of the process and/or a dry stuff requirement set by the quality property of paper between different elements and/or the wire section and the press section, and the control cost, in turn, observes the required power and/or the driving output of the wire section in order to achieve drainage.

The drawings and the specification associated therewith are merely intended to illustrate the idea of the invention. The details of the invention may vary within the scope of the claims. Thus, another type of former solution than the gap former may form the wire section, and in addition to or instead of the dewatering elements shown in FIG. 1 other dewatering elements can be used as the dewatering elements of the wire section. Other methods than vacuum and tensions of the wire can also be used to provide the web with a dewatering pressure.

The invention claimed is:

1. A method for adjusting the operation of a wire section, the method comprising:

determining the development of the consistency of stock on a wire section, determining the effect of the consistency determined above on the formation and/or porosity of a paper web, and adjusting the development of the consistency on the wire section based on a quality property of paper and/or by optimising a cost function, the quality property of paper including the formation, the porosity and/or a combination defined by the formation and/or the porosity, the cost function including at least the effect of the formation and/or the porosity.

2. A method as claimed in claim 1, wherein the cost function includes the effect of the wire section and/or the drainage ability of the dewatering elements thereof on the consistency.

3. A method as claimed in claim 1, the method further comprising:

determining an optimum value for the consistency in such a manner that a ratio between a first derivative of the quality property of paper and/or the cost function, and a first derivative of the consistency, is determined.

4. A method as claimed in claim 3, the method further comprising:

searching an optimal operating point for the process regarding the quality property of paper by determining a correct control direction of the consistency by determining the ratio between the first derivative of the quality property of paper and/or the cost function, and the first derivative of the consistency, and determining the size of a control step of the consistency by determining a ratio between a second derivative of the cost function and/or the quality property of paper. and the first derivative of the consistency.

5. A method as claimed in claim 1, the method further comprising determining the development of the consistency on the wire section by:

determining the dry solids content in the paper web after the wire section measuring the amount of water drained by the dewatering elements of the wire section, and calculating the development of the consistency on the wire section based on the drained amount of water.

6. A method as claimed in claim 1, the method further comprising determining the development of the consistency on the wire section by measuring.

7. A method as claimed in claim 1, wherein the development of the consistency is adjusted by regulating a slice opening of a headbox and/or the drainage of a dewatering element.

8. A method as claimed in claim 1, wherein the development of the consistency is adjusted by optimising on the basis of such a cost function that includes a quality deviation cost and a control cost, whereby the quality deviation cost takes into account the runnability of the process, a dry stuff requirement set by the quality property of paper between different elements and/or the wire section and the press section, and the control cost observes the required power and/or the driving output of the wire section in order to achieve drainage.

9. A method as claimed in claim 1, wherein the development of the consistency is optimally adjusted regarding the paper quality utilizing on line measurements concerning the paper quality.

10. A method as claimed in claim 1, wherein a dynamic model is formed concerning the development of the consistency on the wire section, the dynamic model being updated on the basis of the measurements.

11. A method as claimed in claim 1, wherein a fuzzy controller is utilized for adjusting the development of the consistency, in which boundary conditions are determined for the adjustable consistency and for the adjusting variables.

12. A method as claimed in claim 1, the method further comprising:

determining the drainage ability of the dewatering elements in the end portion of the wire section as a function of time, and optimally adjusting, based on said definition, the dry solids content of the web provided by the wire section by adjusting the drainage ability of the dewatering elements.

13. A method as claimed in claim 12, the method further comprising:

forming a dynamic model describing the development of dry stuff, updating the model based on the measurements, and deciding upon the optimal drainage of the wire section in accordance with said model.

14. An apparatus for adjusting the operation of a wire section, the apparatus comprising:

means for determining the development of the consistency of stock on a wire section, means for determining the effect of the consistency determined above on the formation and/or porosity of a paper web, and means for adjusting the development of the consistency on the wire section based on a quality property of paper and/or by optimising a cost function, the quality property of paper including the formation, the porosity and/or a combination defined by the formation and/or the porosity, the cost function including at least the effect of the formation and/or the porosity.

15. An apparatus as claimed in claim 14, wherein the cost function includes the effect of the wire section and/or the drainage ability of the dewatering elements thereof on the consistency.

16. An apparatus as claimed in claim 14, the apparatus further comprising:

means for determining an optimum value for the consistency by determining a ratio between a first derivative of the quality property of paper and/or the cost function, and a first derivative of the consistency.

17. An apparatus as claimed in claim 16, the apparatus further comprising:

means for determining a correct control direction of the consistency by determining the ratio between the first derivative of the quality property of paper and/or the cost function, and the first derivative of the consistency.

and determining the size of a control step of the consistency by determining the ratio between a second derivative of the cost function and/or the quality property of paper, and the first derivative of the consistency.

18. An apparatus as claimed in claim 14, the apparatus further comprising:

means for determining the dry solids content in the paper web after the wire section, measuring means for measuring the amount of water drained by the dewatering elements of the wire section, and calculation means arranged to calculate the development of the consistency on the wire section based on the drained amount of water.

19. An apparatus as claimed in claim 14, the apparatus further comprising means arranged to measure the development of the consistency on the wire section.

20. An apparatus as claimed in claim 14, wherein the means for adjusting the development of the consistency includes means for adjusting the drainage in the dewatering elements of the wire section and/or means for adjusting a slice opening of a headbox.

21. An apparatus as claimed in claim 14, wherein the adjustment apparatus for adjusting the development of the consistency is a multivariable controller.

22. An apparatus as claimed in claim 21, wherein the multivariable controller utilizes a dynamic model describing the development of the consistency on the wire section, and the model is arranged to be updated on the basis of the measurements.

23. An apparatus as claimed in claim 14, the apparatus further comprising a fuzzy controller, in which boundary conditions are determined for the adjustable consistency and for the adjusting variables.

* * * * *